US005762204A

United States Patent [19]

Yang et al.

[11] Patent Number: 5,762,204

[45] Date of Patent: Jun. 9, 1998

[54] FERROFLUID SINK/FLOAT SEPARATORS FOR SEPARATING NONMAGNETIC MATERIALS OF DIFFERENT DENSITIES

[75] Inventors: Fong-Ru Yang; Tei-Chih Cheau, both of Hsinchu, Taiwan

[73] Assignee: Industrial Technology Research Institute, Hsinchu, Taiwan

[21] Appl. No.: 567,243

[22] Filed: Dec. 5, 1995

[51] Int. Cl.[6] ..... B03B 13/04

[52] U.S. Cl. ..... 209/172.5; 209/1; 209/174

[58] Field of Search ..... 209/172, 172.5, 209/174, 175, 192, 194, 1

[56] References Cited

U.S. PATENT DOCUMENTS 3,483,969 12/1969 Rosenweig .
3,788,465 1/1974 Reimers et al. .
3,951,784 4/1976 Kaiser et al. ..... 209/1
4,052,297 10/1977 Mir ..... 209/1
4,113,608 9/1978 Kazama et al. .
4,521,303 6/1985 Hicks et al. ..... 209/172.5

*Primary Examiner*—Karen M. Young
*Assistant Examiner*—Gregory A. Morse
*Attorney, Agent, or Firm*—Bacon & Thomas

[57] ABSTRACT

A ferrofluid sink/float separator for separating nonmagnetic materials of different densities comprises a horizontal separating tank and a magnetic field generating mechanism. The separating tank is filled with a ferrofluid capable of being induced by the magnetic field generating mechanism to have a magnetic field gradient and various apparent densities in the direction of earth gravity. The magnetic field generating mechanism comprises two magnetic poles spaced at an interval and a gap which is defined by the two magnetic poles and is located under the horizontal separating tank.

4 Claims, 2 Drawing Sheets

FERROFLUID SINK/FLOAT SEPARATORS FOR SEPARATING NONMAGNETIC MATERIALS OF DIFFERENT DENSITIES

FIELD OF THE INVENTION

The present invention relates to a device for separating selectively the nonmagnetic materials of different densities by means of the ferrofluid.

BACKGROUND OF THE INVENTION

The ferrofluid sink/float separation of materials is similar in principle to the conventional wisdom that the wood sawdust and the metal particles are different in density, and that the wood sawdust and the metal particles can be therefore separated in water, in which the wood sawdust float while the metal particles sink. However, it must be pointed out here that the ferrofluid sink/float separation of nonmagnetic materials is attained by a floatation force induced by the magnetic field gradient existing in ferrofluid, which can be so changed as to bring about a different apparent density of the ferrofluid acting as a fluid medium. As a result, the apparent density of the ferrofluid can be adjusted by controlling the strength of the magnetic field. It is therefore readily apparent that the ferrofluid sink/float separation method can be used for separating nonmagnetic metals of high densities, such as the scrap metals from automotive vehicle shredding plants, if the apparent density of the ferrofluid is so adjusted to a value therebetween.

The floatation force acting on a nonmagnetic body induced by the magnetic field gradient existing in the ferrofluid can be expressed in terms of an equation of $$F=v[(\rho_s-\rho_f)g-(M/4\pi)\,\bar{\nabla}H]$$

in which F stands for the force acting on the nonmagnetic body; M, an imaginary mean magnetization of the ferrofluid when it replaces the space occupied by the nonmagnetic body; $\nabla H$, a magnetic field gradient; $\rho_s$, the density of the nonmagnetic body; $\rho_f$, the density of the ferrofluid; g, a gravity acceleration; and v, the volume of the nonmagnetic body. The implication of the above equation is that the floatation of the nonmagnetic body in the ferrofluid is guided by the force acting on the nonmagnetic body when the ferrofluid is acted on by an external magnetic field. In the state of equilibrium, the force F, which acts in a vertical direction z, is zero. As a result, the following equation is obtained:

$$\rho=\rho_s=\rho_{f+[(M/4\pi g)*(dH/dz)]}$$

In view of the neutral buoyancy, the apparent density p of the ferrofluid is equal to the density $\rho_s$ of the particle. It can be therefore concluded that the density of the ferrofluid can be altered by adjusting the magnetic field acting on the ferrofluid. For this reason, the ferrofluid sink/float separation of nonmagnetic materials of different densities is possible.

As disclosed in the U.S. Pat. No. 3,483,969, R. E. Rosensweig introduced in 1969 a ferrofluid sink/float separator for separating the nonmagnetic materials of different densities. This ferrofluid sink/float separator is provided with a separating tank in which a ferrofluid is disposed. Two magnetic poles are connected with two sides of the separating tank such that the surface of each magnetic pole and a vertical line form a specific angle for the purpose of bringing about a magnetic field gradient in the plumb direction. The process of separating the nonmagnetic materials of different densities is carried out by introducing a mixture of the nonmagnetic materials of different densities into the separating tank containing a ferrofluid. As the mixture of the nonmagnetic materials is caused to move from the entrance port of the separating tank to the exit port of the separating tank, the nonmagnetic materials of different densities sink respectively to the different areas of the bottom of the separating tank in view of the fact that the vertical magnetic floatation force acting on the nonmagnetic materials is progressively weakened.

A similar separator was disclosed by G. W. Reimers in 1974 in the U.S. Pat. No. 3,788,465. This separator is different from Rosensweig's separator in that the former attains the separation of the nonmagnetic materials of different densities by means of the combined effort of the gravity and the ferrofluid floatation force acting on the nonmagnetic materials in a nonvertical direction. As a result, the nonmagnetic materials of different densities are caused to move on in different paths in the ferrofluid so as to be discharged from the different exit ports of the separator. The separator disclosed by Reimers is not cost-effective in view of the fact that the nonmagnetic materials of different densities are not separated effectively, and that the floating mixture and the sinking mixture still contain certain amount of nonmagnetic materials intended to be separated.

Similar separators were subsequently and respectively disclosed by Leon Mir in the U.S. Pat. No. 4,052,297; Saburo Kazama, et al. in the U.S. Pat. No. 4,113,608; and J. Shimoiizaka, et al. in IEEE Transactions on Magnetics, vol. Mag-16, No. 2, March 1980.

It can be summed up by saying that the above-mentioned separators share one thing in common, as illustrated in FIG. 1. A horizontal separating tank (not shown in the drawing) containing a ferrofluid is disposed between two magnetic poles (N, S) which are spaced at an interval and are provided respectively with a slanted surface facing the horizontal separating tank. The ferrofluid contained in the horizontal separating tank is caused to have a desired apparent density distribution by a magnetic gradient brought about in a plumb direction. A mixture of the nonmagnetic materials of different densities is introduced into the ferrofluid contained in the horizontal separating tank. The nonmagnetic materials of the mixture are therefore separated selectively in the gap between the two magnetic poles.

Such prior art separators as described above have inherent shortcomings, which are expounded explicitly hereinafter.

The prior art separators are not cost-effective in view of the fact that they must be provided with two magnetic poles of a considerable size so as to allow a large amount of the separated nonmagnetic materials to deposit in the separating area located between the two magnetic poles.

The prior art separators are provided respectively with two magnetic poles, each of which has a slanted surface for bringing about a magnetic field gradient in a plumb direction. It is technically difficult to make or modify a magnetic pole having a slanted surface.

The prior art separators are provided respectively with a separating area which is located in the gap between the two magnetic poles and has a rather narrow effective separation zone (thickness).

SUMMARY OF THE INVENTION

It is therefore the primary objective of the present invention to provide a ferrofluid sink/float separator which is capable of overcoming the shortcomings of the prior art ferrofluid sink/float separators described above and is composed of a separating area located over the gap between two magnetic poles so as to take advantage of the magnetic field distribution bought about by the two magnetic poles.

It is another objective of the present invention to provide a ferrofluid sink/float separator comprising two magnetic poles capable of bringing about a magnetic field having magnetic lines parallel to the direction in which the nonmagnetic materials to be separated are transported. As a result, the separation yield capacity of the ferrofluid sink/float separator of the present invention can be easily expanded by enlarging the width of the magnetic poles along with the width increment of the horizontal separating tank of the ferrofluid sink/float separator without adjusting the gap located between the two magnetic poles, i.e. without changing the magnetic field of the two magnetic poles.

The foregoing objectives of the present invention are attained by a ferrofluid sink/float separator for separating nonmagnetic materials of different densities comprising:

a horizontal separating vessel provided at one end thereof with an entrance and at another end thereof with a first exit, said horizontal separating vessel further provided at a bottom thereof with a second exit located between said entrance and said first exit, said horizontal separating vessel being suitable for containing a ferrofluid;

a magnetic field generating mechanism having two spaced magnetic poles which define a gap and are capable of inducing said ferrofluid contained in said horizontal separating vessel to have a magnetic field gradient and various apparent densities in the direction of earth gravity; and a first transporting mechanism disposed in said horizontal separating vessel for transporting nonmagnetic materials from said entrance to said first exit and said second exit;

wherein said gap defined by said two magnetic poles is located under said second exit of said horizontal separating vessel.

DETAILED DESCRIPTION OF THE INVENTION

The present invention provides a ferrofluid sink/float separator for separating nonmagnetic materials of different densities which comprises a horizontal separating tank, a magnetic field generating mechanism, and a first transporting mechanism.

The horizontal separating tank is provided at one end thereof with an entrance and at another end thereof with a first exit and is further provided with a second exit located at the bottom of the tank and between the entrance and the first exit. The horizontal separating tank is designed to contain a magnetic fluid, such as the ferrofluid.

The magnetic field generating mechanism comprises two magnetic poles spaced at an interval for inducing the ferrofluid contained in the horizontal separating tank to have a magnetic field gradient in the direction of earth gravity and to have various apparent densities in the direction of earth gravity.

The first transporting mechanism is disposed in the horizontal separating tank for transporting the nonmagnetic materials from the entrance of the tank to the first exit and the second exit of the tank.

The improvements of the present invention over the prior art include relocation of a gap defined by the two magnetic poles which are spaced at an interval. In other words, the gap of the present invention is located under the second exit of the horizontal separating tank. In addition, the present invention is preferably provided with two magnetic poles capable of generating a magnetic field in a direction parallel to the direction in which the nonmagnetic materials are transported by the first transporting mechanism. Furthermore, the magnetic field generating mechanism of the present invention is preferably an electromagnet of an open loop construction, such as a C-shaped electromagnet.

The second exit of the horizontal separating tank of the present invention is preferably provided with a material discharging trough slanting upwardly and fluid tightly connecting to the second exit. The material discharging trough is provided therein with a second transporting mechanism for removing the nonmagnetic materials deposited at the bottom of the material discharging trough.

The first transporting mechanism of the present invention is preferably provided with two rotary drums capable of turning in the same direction around a horizontal shaft perpendicular to the direction in which the nonmagnetic materials are transported by the first transporting mechanism. The two rotary drums are fastened therebetween with an endless belt which is provided equidistantly on the outer surface thereof with a plurality of scraping plates extending uprightly.

Figure 1:
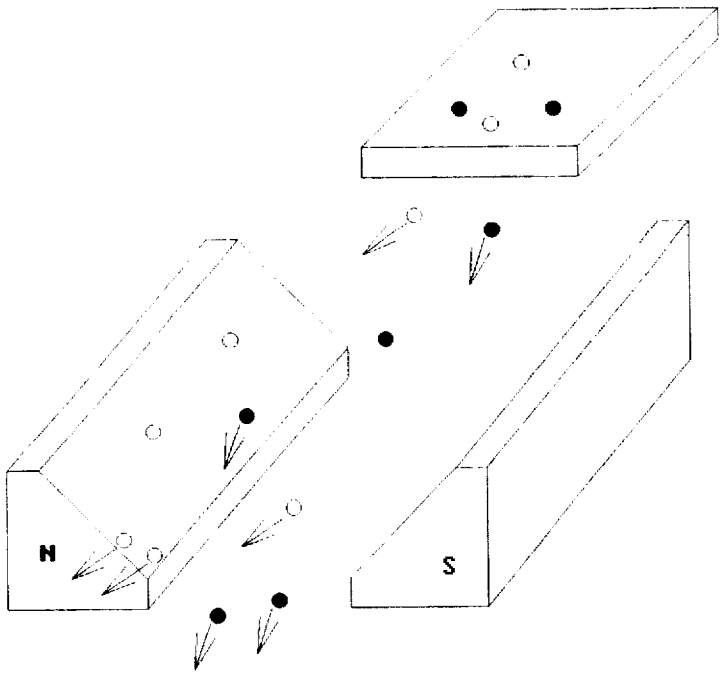
FIG. 1 shows a schematic view of a prior art ferrofluid sink/float separator at work, with two letters "N" and "S" designating two magnetic poles of a magnet, and with arrows indicating the directions in which the nonmagnetic materials are moved.
Figure 2:
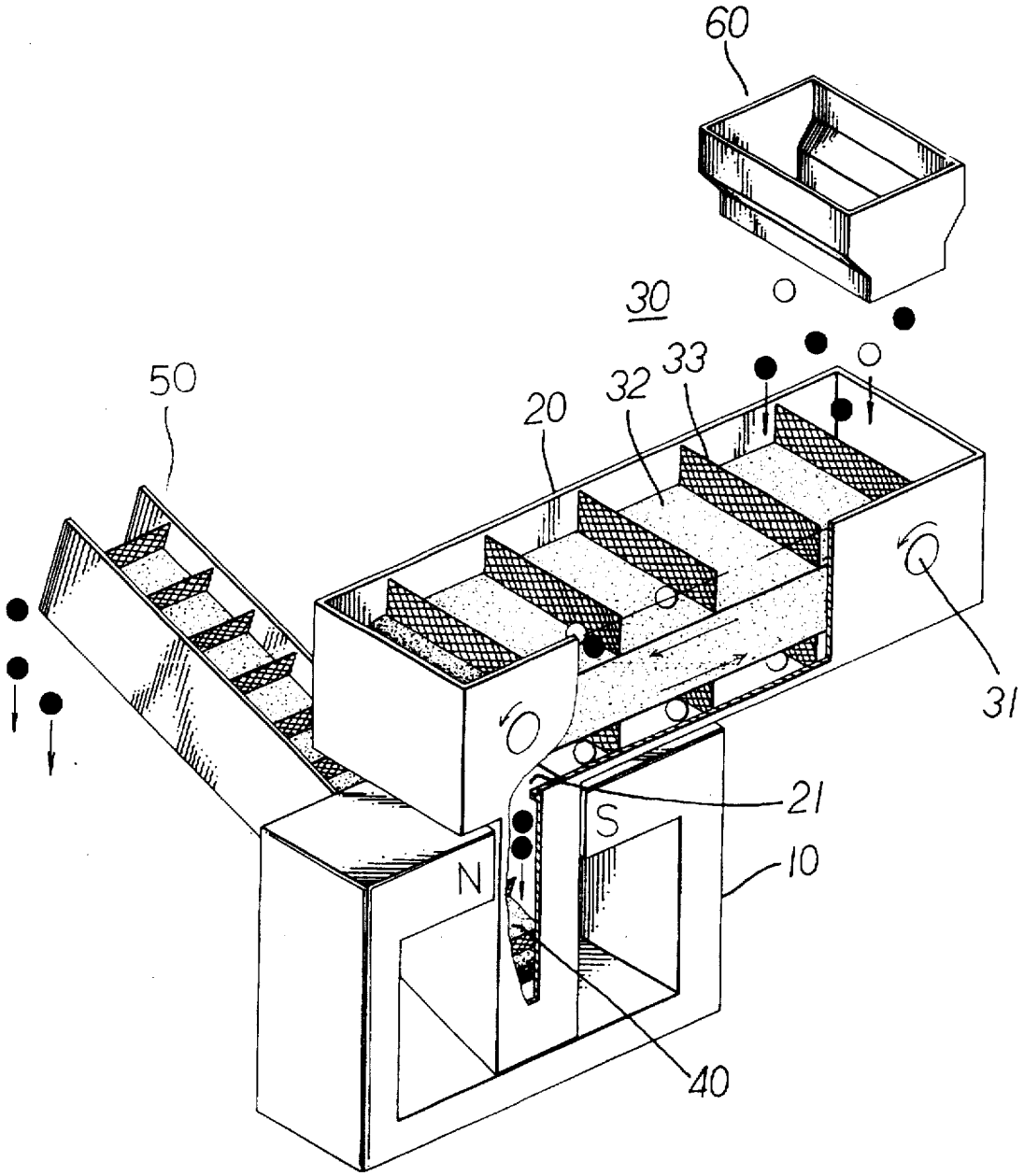
FIG. 2 shows a perspective schematic view of a ferrofluid sink/float separator of a preferred embodiment of the present invention.

A ferrofluid sink/float separator embodied in the present invention is shown in FIG. 2, which comprises a horizontal separating tank 20 made of a nonmagnetic material, an electromagnet 10 having two magnetic poles N and S, a first transporting mechanism 30, a material discharging trough 50 made of a nonmagnetic material, and a second transporting mechanism 40.

The horizontal separating tank 20 of a nonmagnetic material is provided therein with the first transporting mechanism 30 and is filled with a ferrofluid (not shown in the drawing). The horizontal separating tank 20 is provided at the bottom thereof with an exit 21 (the second exit) for discharging the particles of high densities. The material discharging trough 50 is connected in an fluid tight manner with the exit 21 and is filled with the ferrofluid. The particles of high densities are allowed to deposit at the bottom of the material discharging trough 50 via the exit 21.

The two magnetic poles N-S of the electromagnet 10 are located in the opposite direction at two lateral sides of the material discharging trough 50 such that a gap defined by the two magnetic poles N-S is located under the exit 21, and that a magnetic field (magnetic lines) formed by the two magnetic poles N-S reaches beyond the upper portion of the exit 21 and the ferrofluid located over the two magnetic poles N-S. The magnetic field is formed by the two magnetic poles N-S such that the strength of the magnetic field is decreased progressively toward the upper end of a vertical height, and thus a magnetic field gradient is formed in the vertical direction. As a result, the ferrofluid is caused to have vertically various apparent densities. The magnetic field formed by the two magnetic poles N-S of the electromagnet 10 can be adjusted in strength by changing the distance between the two magnetic poles N-S of the electromagnet 10 and by altering the magnitude of an electric current that flows through the electromagnet 10.

The first transporting mechanism 30 comprises two rotary drums 31, which are spaced at an interval and are respectively capable of turning counterclockwise around a horizontal shaft perpendicular to the direction in which the nonmagnetic materials are transported. The first transporting mechanism 30 further comprises an endless belt 32 running on the two rotary drums 31. The endless belt 32 is provided equidistantly on the outer surface thereof with a plurality of scraping plates 33 extending uprightly. Each of the scraping plates 33 is so punched as to allow the ferrofluid to pass therethrough. However, the holes of the scraping plates 33 must be smaller than the particle size of the nonmagnetic materials to be separated, so as to carry effectively the particles of the nonmagnetic materials in the ferrofluid.

The second transporting mechanism 40 is similar in construction to the first transporting mechanism 30; nevertheless the former is disposed upwardly and obliquely in the material discharging trough 50. The second transporting mechanism 40 is intended to move the particles of high densities out of the material discharging trough 50 in an oblique manner so as to ensure that the ferrofluid is kept in the material discharging trough 50. It must be noted here that the particles of high densities are deposited in the material discharging trough 50 via the exit 21.

When the ferrofluid sink/float separator of the present invention described above is provided with a suitable ferrofluid in the horizontal separating tank 20 and an appropriate strength of magnetic field formed by the two magnetic poles N-S of the electromagnet 10, the separator is capable of separating the nonmagnetic materials of different densities such a mariner that the particles of higher densities are grouped together, and that the particles of lower densities are gathered to form another group.

In operation, the particles of the nonmagnetic materials of different densities are fed into the horizontal separating tank 20 via a feeding funnel 60 located over the tank 20, as shown in FIG. 2, in which the particles of higher densities and the particles of lower densities are denoted respectively by black circular dots and blank circles. The particles that are fed into the tank 20 are in fact deposited on the endless belt 32 and are subsequently carried by the scraping plates 33 of the belt 32 to the left end of the tank 20 (the entrance), where the particles are introduced into the bottom layer of the ferrofluid. When the particles are carried through the area located over the exit 21 which is located at the bottom of the tank 20, the particles of higher densities sink and fall via the exit 21 into the material discharging trough 50 through which the particles of higher densities are discharged. On the other hand, the particles of lower densities float and are carried by the scraping plates 33 of the belt 32 to a first exit (not shown in the drawing) which is located at the right end of the tank 20. Such a separation of the particles of different densities as described above is made possible by the fact that the ferrofluid is acted on by the magnetic field formed by the two magnetic poles N-S of the electromagnet 10 so that the ferrofluid is caused to have various apparent densities in vertical direction.

In order to verify the effectiveness of the present invention, an experiment was carried out with the ferrofluid sink/float separator of the present invention for separating the aluminum particles, the zinc particles and the copper particles, which were mixed together prior to the experiment. The ferrofluid sink/float separator used in the experiment is similar in construction to the one illustrated in FIG. 2 and is provided with a horizontal separating tank 20 having a dimension of 60 cm×10 cm×15 cm (L×W×H). The ferrofluid used in the experiment has a 7.0 volume percentage of magnetic particles, a density ($\rho_f$) of 1.2 g/cm$^3$, and a magnetization (M) of 300 gauss.

The mixture used in the experiment is composed of 80% by weight of aluminum, 10% by weight of zinc and 10% by weight of copper. The particles of aluminum, zinc and copper have various radii ranging between 10 mm and 15 mm. The above mixture of aluminum, zinc and copper was formed such that the mixture was similar in composition to a waste automobile body scrap.

The mixture was fed at a constant rate via the feeding funnel 60 into the horizontal separating tank 20, in which a first separating operation was carried out under the action of a magnetic field having a range of 200–400 Oe for bringing about 3–4 apparent density distributions in a 2 cm thick zone of the ferrofluid. The copper particles and the zinc particles were separated and discharged via the material discharging trough 50 when the first separating operation was under way.

The copper and the zinc particles, which were discharged through the material discharging trough 50, were once again fed at a constant rate into the horizontal separating tank 20, in which a second separating operation was carried out under the action of a magnetic field having a range of 500–800 Oe for bringing about 8–8.5 apparent density distributions in a 2 cm thick zone of the ferrofluid. The copper particles were separated and discharged via the material discharging trough 50 when the send separating operation was under way.

The results of the experiment described above are shown in the following Table 1.

TABLE 1

| Feeding rate | Recovery | | | Grade | | |
|---|---|---|---|---|---|---|
| (kg/hr) | Al | Zn | Cu | Al | Zn | Cu |
| 18.5 | 100% | 100% | 100% | 100% | 100% | 100% |
| 46.2 | 100% | 100% | 92% | 100% | 99% | 100% |
| 102.1 | 100% | 98% | 90% | 100% | 99% | 96% |

According to the above table, it is readily apparent that the ferrofluid sink/float separator of the present invention is capable of separating and recovering more than 90% of aluminum, zinc and copper particles having a grade higher than 96%.

The afore-mentioned experiment was conducted by the present inventors of the application in such a manner that two separating operations were involved. It is suggested that the separation of the particles can be also attained successfully by using two ferrofluid sink/float separators which are connected in series.

It must be pointed out here that the feeding rate of the ferrofluid sink/float separator of the present invention can be accelerated as desired by increasing the width of the horizontal separating tank 20 as well as the width of the magnetic poles N-S of the electromagnet 10, in view of the fact that the strength of magnetic field is independent of the width of the magnetic poles N-S. If the direction of the magnetic lines of the magnetic poles is perpendicular to the direction in which the nonmagnetic materials are transported, the width of the horizontal separating tank 20 and the distance between the two magnetic poles N-S must be increased at the same time so as to alter the magnitude of the magnetic field brought about by the magnetic poles N-S. In the meantime, it is necessary to readjust the electric current which flows through the electromagnet 10, so as to resume the desired apparent densities distribution in the ferrofluid.

The ferrofluid sink/float separator of the present invention has inherent advantages, which are expounded explicitly hereinafter.

The Ferrofluid sink/float separator of the present invention is provided with a particle-separating area which is located over the gap between the two magnetic poles so as to ensure that almost the entire magnetic field having a magnetic gradient is used by the particle-separating area. Therefore, the magnetic poles N-S of the electromagnet 10 are greatly reduced in volume.

According to the present invention, the particle-separating operation can be cut short when the direction of the magnetic lines is parallel to the direction in which the nonmagnetic materials to be separated are transported. In addition, a plurality of paired magnetic poles, each pair of which define a gap and generate different magnetic fields, can be arranged in series within a certain length under the horizontal separating tank so that matters of different densities can be therefore separated in series in the ferrofluid sink/float separator of the present invention.

What is claimed is:

1. A ferrofluid sink/float separator for separating nonmagnetic materials of different densities comprising:

a horizontal separating vessel provided at one end thereof with an entrance and at another end thereof with a first exit, said horizontal separating vessel further provided at a bottom thereof with a second exit located between said entrance and said first exit, said horizontal separating vessel being suitable for containing a ferrofluid;

a magnetic field generating mechanism having two spaced magnetic poles which define a gap and are capable of inducing said ferrofluid contained in said horizontal separating vessel to have a magnetic field gradient and various apparent densities in the direction of earth gravity; and a first transporting mechanism disposed in said horizontal separating vessel for transporting nonmagnetic materials from said entrance to said first exit and said second exit;

wherein said gap defined by said two spaced magnetic poles is located under said second exit of said horizontal separating vessel; and wherein said two spaced magnetic poles are capable of generating magnetic lines parallel to a direction in which said nonmagnetic materials are transported by said first transporting mechanism.

2. The ferrofluid sink/float separator as defined in claim 1, wherein said magnetic field generating mechanism comprises an electromagnet of an open loop construction.

3. The ferrofluid sink/float separator as defined in claim 1, wherein said second exit of said horizontal separating vessel is connected in a fluid tight manner with a material discharging trough extending upwardly and obliquely, said material discharging trough provided therein with a second transporting mechanism for transporting upwardly and obliquely said nonmagnetic materials deposited at a bottom of said material discharging trough.

4. The ferrofluid sink/float separator as defined in claim 1, wherein said first transporting mechanism is provided with two rotary drums which are spaced at an interval and are capable of turning in the same direction around a horizontal shaft perpendicular to a direction in which said nonmagnetic materials are transported by said first transporting mechanism, said two rotary drums provided with an endless belt running thereon and therebetween and having equidistantly on an outer surface thereof a plurality of scraping plates extending uprightly.

* * * * *